United States Patent [19]

Okuda

[11] 4,142,710

[45] Mar. 6, 1979

[54] AUTOMATIC EXTENSION CONTROL SYSTEM FOR JACKING DEVICE

[75] Inventor: Toru Okuda, Marugame, Japan

[73] Assignee: Tadano Ltd., Kagawa, Japan

[21] Appl. No.: 855,465

[22] Filed: Nov. 28, 1977

[30] Foreign Application Priority Data

Dec. 1, 1976 [JP] Japan ..... 51/145141

[51] Int. Cl.[2] ..... B66F 7/26

[52] U.S. Cl. ..... 254/86 H; 280/6.1

[58] Field of Search ..... 254/45, 86 R, 86 H; 280/6 H, 6.1, 6.11

[56] References Cited

U.S. PATENT DOCUMENTS

| | | | |
|---|---|---|---|
| 3,669,409 | 6/1972 | Eranosian | 254/45 |
| 3,888,464 | 6/1975 | Felsen | 254/86 R |

*Primary Examiner*—Robert C. Watson

*Attorney, Agent, or Firm*—Martin A. Farber

[57] ABSTRACT

Extension control system for jacking device for traveling loading machines such as truck crane for jacking up during the loading operation, keeping the machine in the horizontal position, which comprises at least four oil hydraulic jacks for supporting the traveling loading machine, means for supplying pressure oil to the hydraulic cylinder of each jack, means for sensing level of the traveling loading machine, and a stroke-end sensing device provided for each jack operative to generate a signal when the jack extends to the stroke-end. The system is so arranged that the conduit for supplying the pressure oil to the cylinder for the jack in higher side is shut-off, when the machine tilts and the means for sensing the lift of the machine is actuated, and further the extension of all jacks is stopped, when at least one of the stroke-end sensing device is actuated.

4 Claims, 7 Drawing Figures

AUTOMATIC EXTENSION CONTROL SYSTEM FOR JACKING DEVICE

The present invention relates to an automatic extension control system for jacking device having four or more hydraulic jacks which are provided for supporting a traveling loading machine such as truck crane. The truck crane comprises a crane which is rotatably mounted on the frame of the truck. To ensure the safety at loading in working ground, the truck is supported by four or more hydraulic jacks. The hydraulic jacks are suitably arranged about the center of gravity of the loading machine and individually operative in order to lift and support the truck in the horizontal position. It is particularly important to jack up and support the truck horizontally on working ground to prevent the generation of undesired rotating forces on a loading machine.

The swing mechanism of the crane is designed to have a high strength against the force along the plane perpendicular to the frame plane of the truck. Therefore, the undesired rotating forces exerted on the crane generate excessive stress in the swing mechanism of the crane.

Conventionally, each hydraulic jack is handled manually to jack up the vehicle for traveling loading machine. However, in the case that the vehicle is supported four or more jacks, it is very difficult to control extension and retraction of the respective jacks maintaining the support of all jacks horizontally, that would take much time and skill. Therefore, the object of the present invention is to provide an extension control system for the jack devices which may automatically keep the support of all of jacks and jack up the traveling loading machine in the horizontal position without particular skill.

Figure 1:
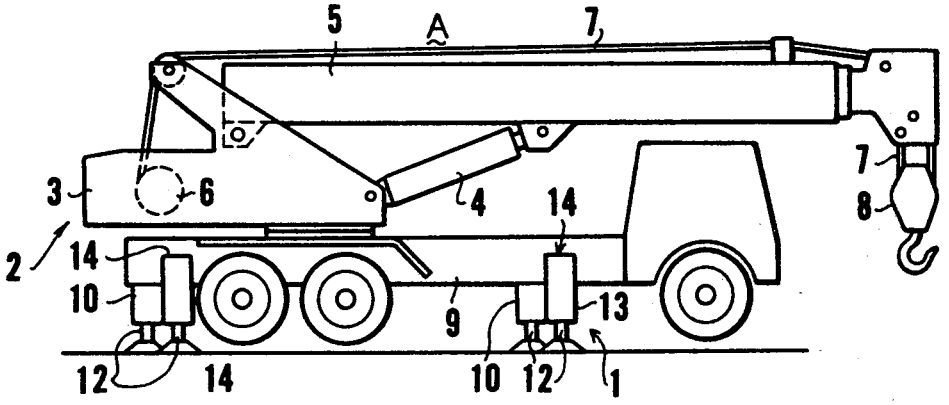
Figure 2:
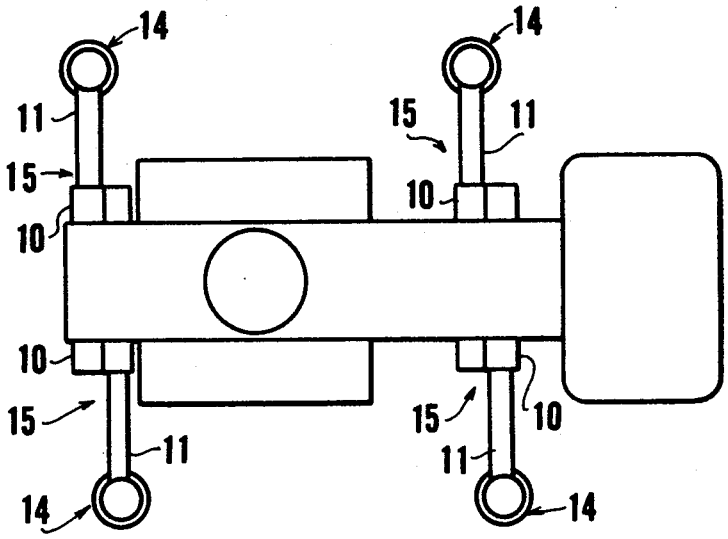
Figure 3:
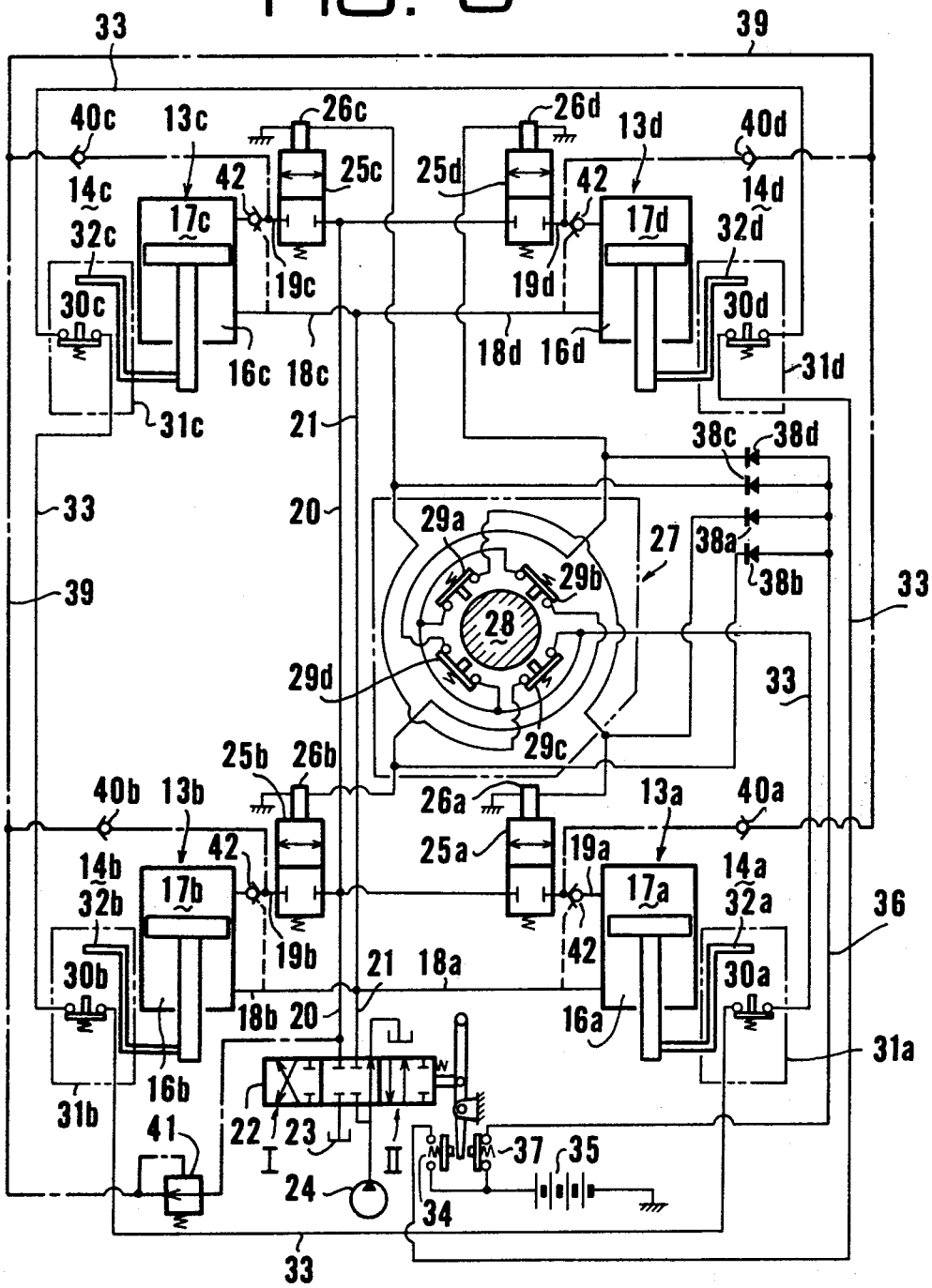
Figure 4:
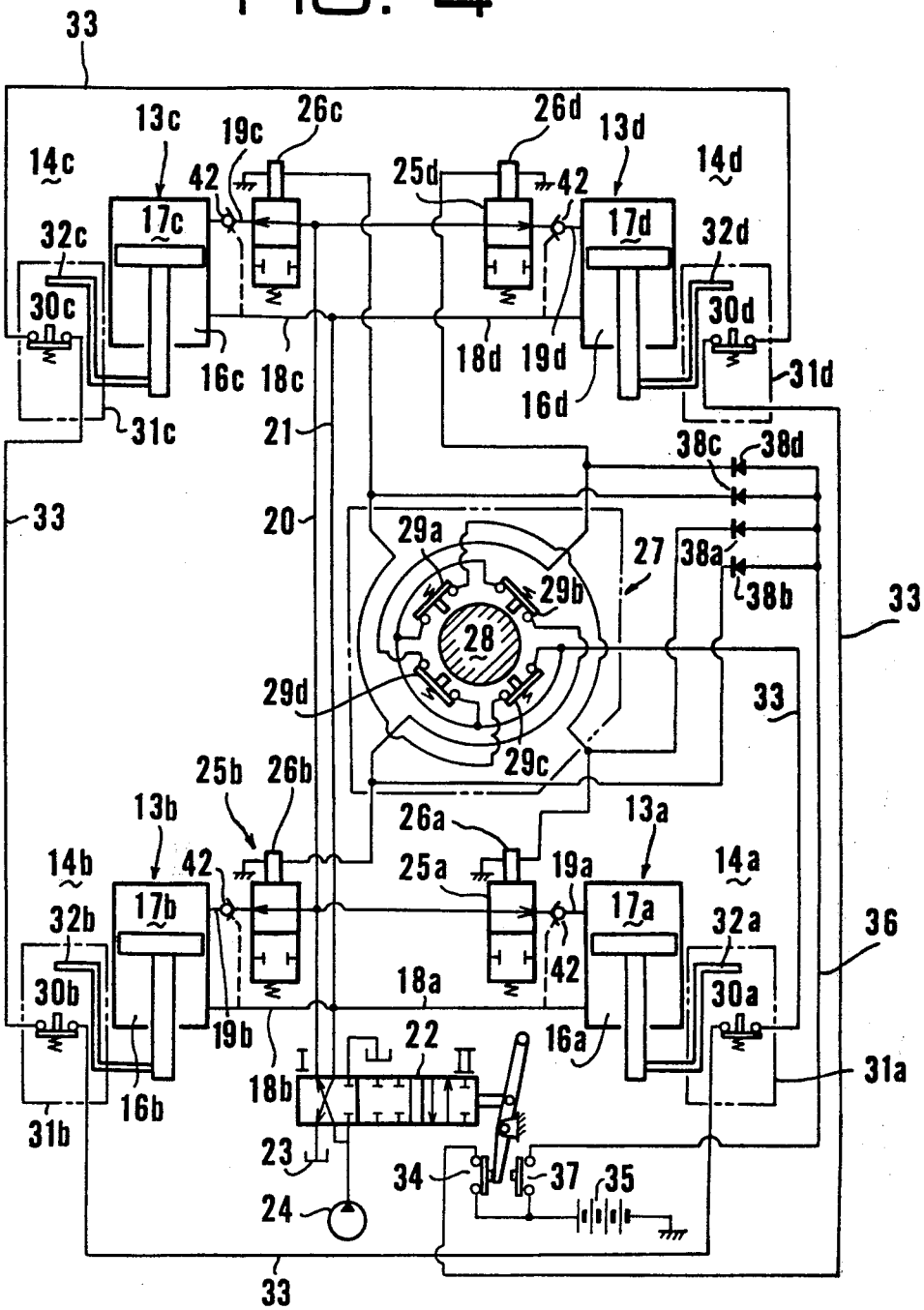
Figure 5:
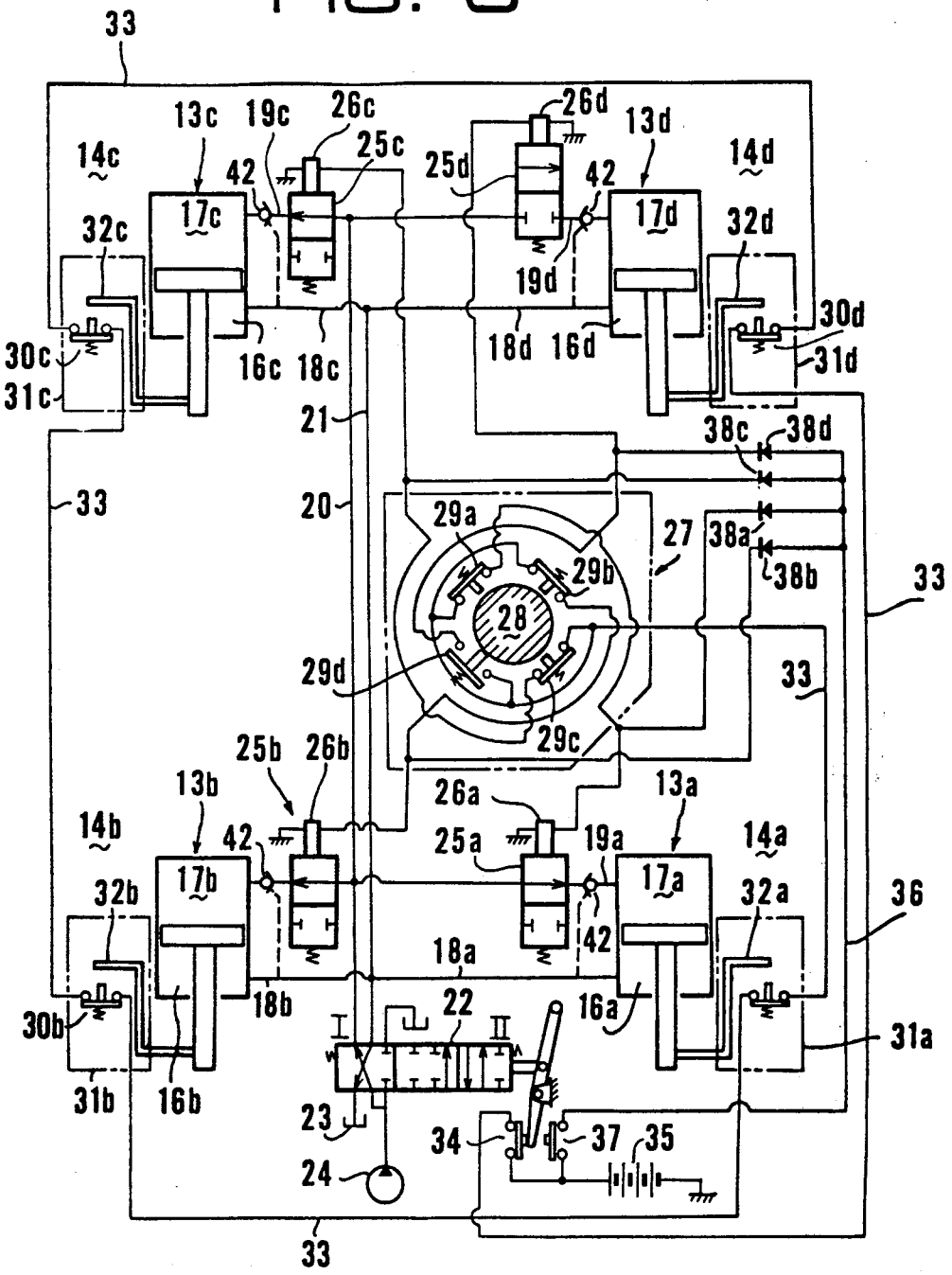
Figure 6:
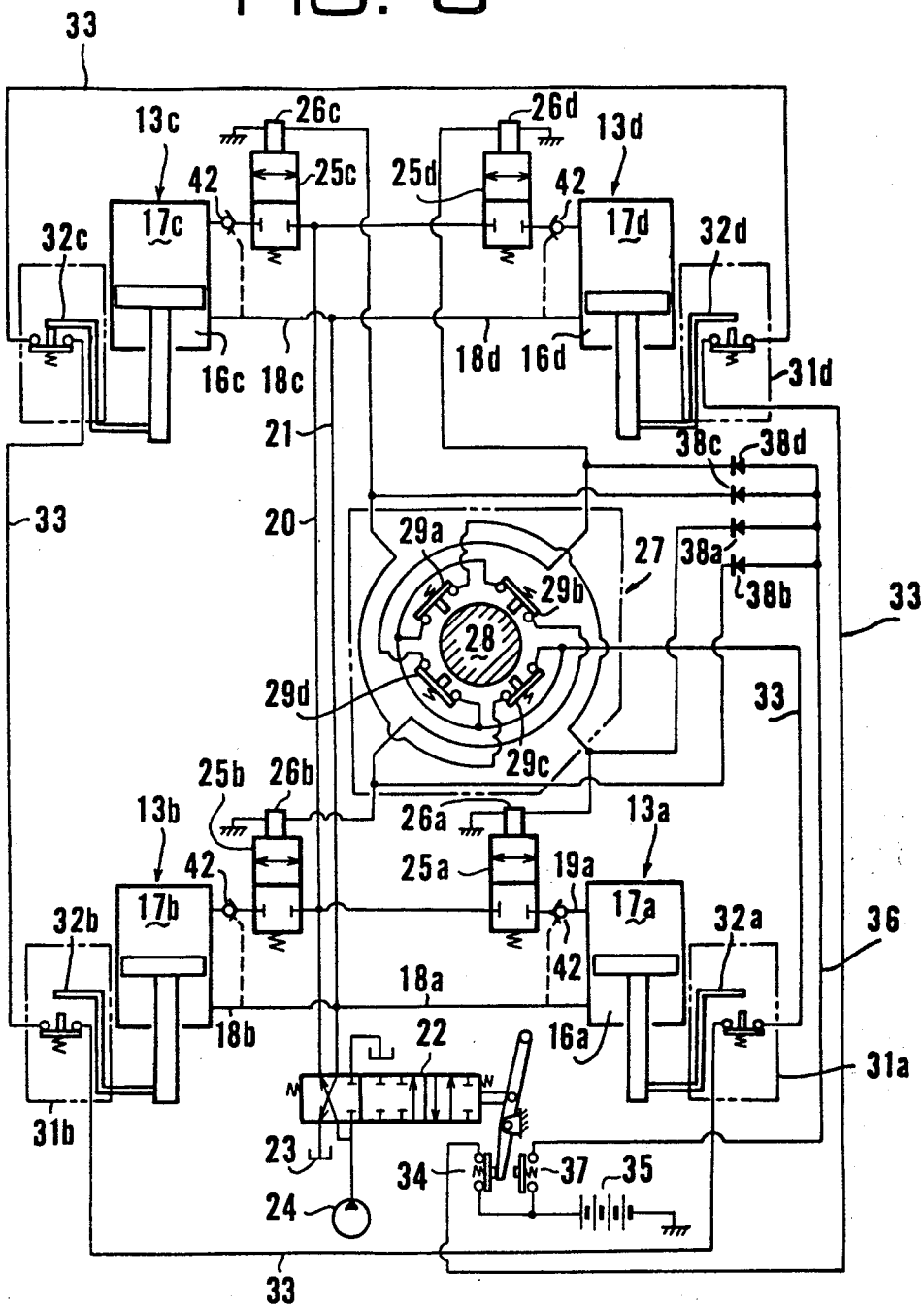
Figure 7:
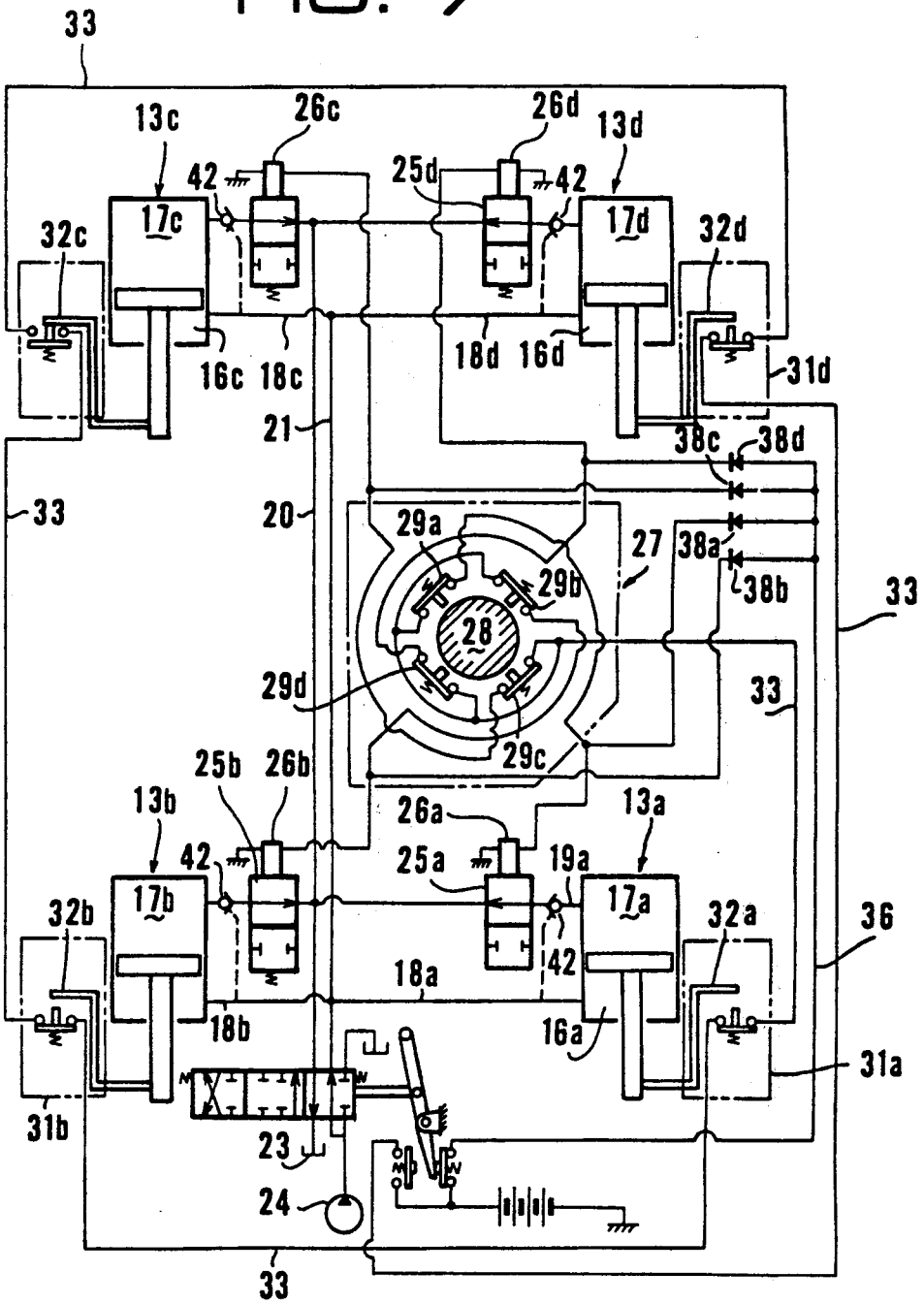

These and other objects, features and advantages of the present invention will become more apparent from the following description when taken in conjunction with the accompanying drawings, in which:

FIG. 1 is a side view of a truck crane, to which the present invention is applied, FIG. 2 is a plan view of the vehicle section illustrated in FIG. 1, FIGS. 3 to 7 illustrate control circuit diagrams of the jack device embodying the present invention, of which FIG. 3 shows the diagram in the retracted state of the jacks, FIGS. 4 and 5 show the diagram under extension of the jacks, FIG. 6 shows the diagram in extended state, and FIG. 7 shows the diagram under retraction of the jacks.

Referring to FIGS. 1 and 2, a truck crane A comprises a vehicle (1) and a crane (2) rotatably mounted theron. The crane (2) consists of a turntable (3) and a telescoping boom (5). The boom is pivotally mounted on the horizontal axis provided on the turntable (3) and raised or lowered by means of an oil hydraulic cylinder (4). At the end of the extensible member, referred as a "stinger", a hookblock (8) hangs by a rope (7) which is wound up by a winch (6) provided on the turntable (3). Four hydraulic outriggers (15) are provided on opposite sides of the vehicle. Each of the outriggers comprises a base cylinder (10) laterally supported on a flame (9) of the vehicle (1), a lateral beam (11) slidably inserted in the base cylinder (10), and a hydraulic vertical jack (14) comprising an oil hydraulic cylinder (13) fixed at the end of the beam (11) and having a piston rod (12). The outriggers are so arranged that the jacks take positions surrounding the center of gravity of the truck crane. The outriggers (15) are to jack up and stabilize the vehicle (1) when operating the crane of the truck crane A.

Referring now to FIGS. 3 to 7, the extension control system for four jacks will be explained (hereinafter jacks are numbered as 14*a*, 14*b*, 14*c* and 14*d*, respectively, from the right-front one and clockwisely, and the oil hydraulic cylinders are numbered as 13*a*, 13*b*, 13*c* and 13*d*, respectively, likewise). Retraction side chambers (16*a*, 16*b*, 16*c*, 16*d*) and extension side chambers (17*a*, 17*b*, 17*c*, 17*d*) of oil hydraulic cylinders (13*a*, 13*b*, 13*c*, 13*d*) for jacks (14*a*, 14*b*, 14*c*, 14*d*) are communicated respectively to a second conduit (21) and a first conduit (20) through conduits (18*a*, 18*b*, 18*c*, 18*d*) and conduits (19*a*, 19*b*, 19*c*, 19*d*). The first and second conduits (20, 21) are selectively communicated to an oil pump (24) and a tank (23) respectively through a four directional three position valve (22). Solenoid operated shut-off valves (25*a*, 25*b*, 25*c* and 25*d*) operated by solenoids (26*a*, 26*b*, 26*c*, 26*d*) are provided on the conduits (19*a*, 19*b*, 19*c*, 19*d*) connected to extension side chambers (17*a*, 17*b*, 17*c*, 17*d*) of hydraulic cylinders (13*a*, 13*b*, 13*c*, 13*d*), respectively. Each of the solenoid operated shut-off valves (25*a*, 25*b*, 25*c*, 25*d*) is normally closed by a spring and opened when the solenoid is energized.

A sensing device (27) detects the tilt or level of the vehicle (1). The sensing device comprises a weight (28) suspended from the vehicle body and four normally closed switches (29*a*, 29*b*, 29*c*, 29*d*) surrounding the weight. The switches are arranged such that when the vehicle (1) tilts to a certain degree, the switch positioned in the lower level is opened. That is to say, when the vehicle (1) is not in the horizontal position, the weight swings toward the tilted direction so that the lower side switch is opened. For example, the switch (29*a*) is opened when the vehicle is tilted to the side of the jack (14*c*), and the switch (29*b*) is opened when tilted to the side of the jack (14*d*). Each of the switches (29*a*, 29*b*, 29*c*, 29*d*) is connected to the corresponding solenoid of the jack opposite the weight (28) and all the switches are connected in parallel to a stroke-end sensing circuit (33) which will be described afterwards.

The jacks (14*a*, 14*b*, 14*c*, 14*d*) are provided with stroke-end sensing devices (31*a*, 31*b*, 31*c*, 31*d*) respectively. Each stroke-end sensing device consists of a normally closed switch and a striker provided on the piston rod. In the drawings, the switches and strikers are numerated as 30*a* to 30*d* and 32*a* to 32*d*. Each of the switches (30*a*, 30*b*, 30*c*, 30*d*) is operated by the striker as the corresponding jack extends to the stroke-end. Switches (30*a*, 30*b*, 30*c*, 30*d*) are connected in series and form a stroke-end sensing circuit (33). Accordingly, the stroke-end sensing circuit (33) is cut off when at least one jack is extended to the stroke-end. The stroke-end sensing circuit (33) is connected in parallel at one end to switches (29*a*, 29*b*, 29*c*, 29*d*) as above-mentioned, and at the other end to an electric power source (35) through a switch (34) which is closed when the four directional three position control valve (22) is shifted to take position I. In the position I of the valve, the pump (24) is communicated to the conduit (20) and the tank (23) is connected to the conduit (21).

A circuit (36) is for retracting of the jacks (13*a*, 13*b*, 13*c*, 13*d*), which is connected at one end to the source (35) through a switch (37) which is closed when the four directional three position hydraulic control valve

(22) is operated to take the position II, and at the other end, is connected in parallel to the afore-mentioned solenoids (26a, 26b, 26c, 26d) through respective diodes (38a, 38b, 38c, 38d). The diodes (38a, 38b, 38c, 38d) are provided to prevent a short circuit of the solenoids (26a, 26b, 26c, 26d).

Operation of the system will be described hereinafter.

Previous to operating the crane on the traveling truck crane A, the vehicle (1) is jacked up. The jacking up is caused by operating the four directional three-position control valve (22) to shift it to the position I from the center valve position shown in FIG. 3. In the position I, pressurized oil is supplied from the pump (24) to the first conduit (20), while the oil is returned through the second conduit (21) to the tank (23), the condition of which is illustrated in FIG. 4. Shifting of the four directional three-position hydraulic control valve (22) causes the switch (34) to close, thereby connecting the electric power source (35) to the jack extending circuit which comprises the stroke-end sensing circuit (33), switches (29a, 29b, 2929d) and solenoids (26a, 26b, 26c, 26d). All the switches (30a, 30b, 30c, 30d) (29a, 29b, 29c, 29d) are closed, if the vehicle (1) is held in the horizontal position, so that the solenoids (26a, 26b, 26c, 26d) are all energized to open all the shut-off valves (25a, 25b, 25c, 25d). Accordingly, pressurized oil is supplied to the extension side chambers (17a, 17b, 17c, 17d) of hydraulic cylinders (13a, 13b, 13c, 13d), so that the jacks (14a, 14b, 14c, 14d) are extended. If one of the jacks, for example, the jack (14d) extends higher than the others, because of the deviation of the loads on the truck crane A held by the jacks, or the resistance difference between conduits communicated to respective hydraulic cylinders (13a, 13b, 13c, 13d) or of other reasons, the truck tilts to the lower jack (14b), so that the switch (29d) corresponding to the jack (14d) in the high position, is opened. Therefore, the solenoid (26d) is de-energized shutting off the solenoid valve (25d), thereby stopping the extension of the jack (14d). As shown in FIG. 5, then the jacks (14a, 14b, 14c) other than the jack (14d) remain working by the pressurized oil supply to their extension side hydraulic chamber (17a, 17b, 17c) of the hydraulic cylinders (13a, 13b, 13c) to extend up to the level of the jack (14d) to hold the vehicle (1) horizontal. As the vehicle (1) regains the horizontal position, all the switches (29a, 29b, 29c, 29d) are closed so that all the jacks (14a, 14b, 14c, 14d) are operated for jacking up the vehicle (1) as shown in FIG. 4. Thus, the jacks (14a, 14b, 14c, 14d) jack up the vehicle (1) keeping it horizontal. When at least one of the jack devices (14a, 14b, 14c, 14d), for example, the device (14c) is extended to the stroke-end, the striker (32c) opens the switch (30c) of the stroke-end sensing device (31c) for the jack (14c) to cut off the stroke-end sensing circuit (33). As the result, all the solenoid valves (26a, 26b, 26c, 26d) are de-energized so that shut-off valves (25a, 25b, 25c, 25d) are closed, stopping the pressurized oil supply to the extension side hydraulic chamber (17a, 17b, 17c, 17d) of the respective cylinder (13a, 13b, 13c, 13d) and suspending the extension of the jacks (14a, 14b, 14c, 14d). The extension of the jacks (14a, 14b, 14c, 14d) is accomplished by returning the four directional three position hydraulic control valve (22) to the central position as shown in FIG. 6.

In order to lower the vehicle (1) jacked up by the jacks to truck travel level, the four directional three position hydraulic control valve (22) is shifted the position II to communicate the pump (24) and the tank (23) to the second conduit (21) and the first conduit (20), respectively, whereby closing of the switch (37) completes the retracting circuit (36) to cause the energizing of all the solenoids (26a, 26b, 26c, 26d). Therefore, the shut-off solenoid valves (25a, 25b, 25c, 25d) are opened, pressure oil is supplied to the retraction side chambers (16a, 16b, 16c, 16d) and oil in each of extension side chambers (17a, 17b, 17c, 17d) is discharged through a pilot operated check valve (42) which is operated by the pressure oil supplied to the retraction side chamber to permit the oil to flow therethrough. Thus, all the jacks are retracted regardless of the conditions of level sensing device (27) and the stroke-end sensing devices (31a, 31b, 31c, 31d).

As the present invention is so arranged that all of the jacks support the traveling loading machine in the horizontal position, and that when one of the jack extends to the stroke-end, all the other jacks stop jacking up the vehicle, the system of the present invention may assure stability and security of the operation of the loading and also raise the working efficiency of the loading machine.

In this embodiment, because the oil supply is carried out through the only one conduit (20) to the extension side hydraulic chambers (17a, 17b, 17c, 17d) of the respective hydraulic cylinders (13a, 13b, 13c, 13d) of the respective jacks (14a, 14b, 14c, 14d), all the jacks are extended bearing the weight of the traveling loading machine. More particularly, if one of the jacks does not support the weight, the oil pressure in the extending side chamber of the hydraulic cylinder of the jack becomes lower than that of the other jacks supporting the weight. Therefore, the larger amount of oil is supplied to the chamber of the unburdened jack, thereby to extend the jack for loading the weight. In the case that there are great differences of resistance in the conduits to the extension side hydraulic chamber (17a, 17b, 17c, 17d), it may occur that the above mentioned function is not carried out and one of the jacks does not support the vehicle. It is possible to improve the system to guarantee the support of the traveling loading machine by all the jacks. In an embodiment of the present invention, a low pressure oil supply circuit is provided to supply low pressure oil to the extension side hydraulic chamber (17a, 17b, 17c, 17d) continuously regardless to the condition of the shut-off solenoid valve (25a, 25b, 25c, 25d) when jacking up. The low pressure oil supply circuit is shown as (39) in FIG. 3, the circuit (39) is connected at one end to the first conduit (20) through a pressure reducing valve (41), and at the other end to the conduits (19a, 19b, 19c, 19d) through the respective check valves (40a, 40b, 40c, 40d). The circuit may supply the oil at a low pressure which is not so high as to jack up each jack.

In the above embodiment, jacks (14a, 14b, 14c, 14d) are retracted by operating the four directional three position hydraulic control valve (22) to position II to complete the retracting circuit (36) to open the shut-off solenoid valves (25a, 25b, 25c, 25d). As another retracting system, it is possible to retract all jacks by the provision of a check valve in parallel to each shut-off solenoid valve to allow the oil flow to the first conduit from the extension side hydraulic chamber of each hydraulic cylinders (13a, 13b, 13c 13d).

What is claimed is:

1. Extension control system for a jacking device for a traveling loading machine having a pressure oil source and tank comprising at least four means comprising oil hydraulic jacks simultaneously all for supporting and elevating the traveling loading machine, each of said jacks having a hydraulic cylinder and a piston therein defining extension and retraction chambers on opposite sides of the piston, respectively, conduit means for communicating said chambers on opposite sides of the piston in said hydraulic cylinder of each of said jacks with the pressure oil source and the tank, respectively, a directional control valve for selectively changing communication between the pressure oil source, the tank and said chambers of each said hydraulic cylinder into an extending or retracting communication, respectively, of said piston and said jack, a shut-off valve provided in a portion of the conduit means connected to said extension chamber of said hydraulic cylinder of each said jack, respectively, constituting means when actuated for closing communication between said extension chamber and said pressure oil source, sensing means for continuously sensing tilt of the traveling loading machine while said jacks elevate said traveling loading machine and for generating a first signal upon sensing a tilted condition of the traveling loading machine, means for actuating said shut-off valves, respectively, said means for actuating the shut-off valves for operatively actuating the shut-off valve for the jack in a higher side only when the traveling loading machine tilts and said sensing means generates said first signal, said actuating means for opening said shut-off valve of said jack in said higher side when a level condition of the traveling loading machine is regained, a stroke-end sensing means for each said jack for operatively generating a second signal upon actuation thereof when the associated said jack extends to a stroke-end position, and means for stopping pressure oil communication to said extension chamber of said hydraulic cylinders of all said jacks by actuating all said shut-off valves when at least one of said stroke-end sensing means is actuated to generate said second signal, thereby to stop the elevation of the traveling loading machine

2. Extension control system for a jacking device for a traveling loading machine in accordance with claim 1 in which said shut-off valve comprises a solenoid operated shut-off valve, said means for sensing tilt of the traveling loading machine comprises a weight suspended from the body of the machine and switches positioned around the weight corresponding to said jacks, respectively, and adapted to be actuated by the weight when the machine tilts, and said means for actuating the shut-off valves constitute an electric circuit, said switches are so arranged in the electric circuit as to actuate the solenoid operated shut-off valve for the jack positioned in the higher side.

3. Extension control system for a jacking device for a traveling loading machine in accordance with claim 1 in which said shut-off valve comprises a solenoid operated shut-off valve, said means for sensing tilt of the traveling loading machine comprises a weight suspended from the body of the machine and switches positioned around the weight corresponding to said jacks, respectively, and adapted to be actuated by the weight when the machine tilts, said means for actuating the shut-off valves constitute an electric circuit, the switches are so arranged in the electric circuit as to actuate the solenoid operated shut-off valve for the jack positioned in the higher side, and said stroke-end sensing means comprises a switch actuated when the jack extends to the stroke end, all said switches are connected in series in said electric circuit, whereby when at least one of said stroke-end sensing means is actuated, the electric circuit is cut-off thereby to stop elevating the traveling loading machine.

4. Extension control system for jacking device for traveling loading machines having a pressure oil source and tank comprising at least four means comprising oil hydraulic jacks simultaneously all for supporting and elevating the traveling loading machine, each of said jacks having a hydraulic cylinder and a piston therein defining extension and retraction chambers on opposite sides of the piston, conduit means for communicating said chambers on opposite sides of said piston in said hydraulic cylinder of each of said jacks with the pressure oil source and the tank, respectively, a directional control valve for selectively changing communication between the pressure oil source, the tank, and said chambers of each said hydraulic cylinder into an extending or retracting communication, respectively, of said piston and said jack, a shut-off valve provided in a portion of the conduit means connected to said extension chamber of said hydraulic cylinder of each said jack, respectively, constituting means when actuated for closing communication between said extension chamber and said pressure oil source, sensing means for continuously sensing tilt of the traveling loading machine while said jacks elevate said traveling loading machine and for generating a first signal upon sensing a tilted condition of the traveling loading machine, means for actuating said shut-off valves, respectively, said means for actuating the shut-off valves for operatively actuating the shut-off valve for the jack in a higher side only when the traveling loading machine tilts and said sensing means generates said first signal, said actuating means for opening said shut-off valve of said jack in said higher side when a level condition of the traveling loading machine is regained, a stroke-end sensing means provided for each said jack for operatively generating a second signal upon actuation thereof when the associated said jack extends to a stroke-end position, means for stopping the pressure oil communication to said extension chamber of said hydraulic cylinders, of all said jacks by actuating all said shut-off valves when at least one of said stroke-end sensing means is actuated to generate said second signal, thereby to stop the elevation of the traveling loading machine, and means for additionally supplying the pressure oil into the extension chamber of each said hydraulic cylinder at a pressure not so high as to extend said jacks.

* * * * *